United States Patent [19]

Malik

[11] 4,246,942

[45] Jan. 27, 1981

[54] MEANS FOR SPLITTING LOGS

[76] Inventor: Henry Malik, Rte. 2, Box 296A, Yankton, S. Dak. 57078

[21] Appl. No.: 4,022

[22] Filed: Jan. 17, 1979

[51] Int. Cl.[3] ..... B27L 7/00

[52] U.S. Cl. ..... 144/193 A; 144/193 R; 414/723

[58] Field of Search ..... 144/193 R, 193 A, 323; 414/723

[56] References Cited

U.S. PATENT DOCUMENTS

| | | | |
|---|---|---|---|
| 3,760,854 | 9/1973 | Worthington | 144/193 A |
| 3,780,779 | 12/1973 | Guy | 144/193 A |
| 4,073,325 | 12/1978 | Krom, Jr. | 144/193 A |
| 4,111,246 | 9/1978 | LaPointe | 144/193 A |
| 4,155,385 | 5/1979 | LaPointe | 144/193 A |

*Primary Examiner*—W. Donald Bray
*Attorney, Agent, or Firm*—Zarley, McKee, Thomte, Voorhees & Sease

[57] ABSTRACT

The means for splitting logs comprises an apparatus adapted to be attached to the front end loader of a tractor and to be connected to the hydraulic cylinder on the front end loader for splitting the logs. The device comprises a frame assembly secured to the front end of the loader and having a cutting wedge rigidly secured to the forward end of the frame assembly. A ram bar is slidably mounted on the frame assembly and adapted to slide towards and away from the cutting wedge. The ram bar is connected to the cylinder on the loader so that the cylinder can forceably move the ram bar towards the cutting edge whereby a log longitudinally positioned between the ram bar and the cutting wedge will be impaled upon and split by the cutting wedge. The frame assembly is mounted to the front end loader by first removing the bucket from the front end loader and by attaching the frame assembly to the front end loader in the place where the bucket was previously attached.

7 Claims, 6 Drawing Figures

MEANS FOR SPLITTING LOGS

BACKGROUND OF THE INVENTION

This invention relates to a method and means for splitting logs, and particularly to a method and means for splitting logs which can be utilized in combination with a conventional hydraulically operated front end loader.

Hydraulic log splitting devices have been utilized in the prior art, but these devices usually require their own hydraulic cylinders for driving and forcing the log against a splitting wedge. Hydraulically operated front end loaders have also been utilized with tractors and these loaders usually include two sets of hydraulic cylinders, one set for raising and lowering the arms, and a second set for controlling the operation of the bucket on the front end loader.

SUMMARY OF THE INVENTION

The present invention utilizes a long splitting device which may be attached to the front end loader in the place of the bucket normally carried by the front end loader. The bucket is removed and the log splitting device of the present invention is mounted in its place. The log splitting device is then connected to the hydraulic cylinders which were previously used for operating the bucket. The hydraulic cylinders move a ram on the log splitting device which forces the log toward a wedge mounted at the forward end of the log splitting device.

Therefore, a primary object of the present invention is the provision of an improved method and means for splitting wood logs.

A further object of the present invention is the provision of a method and means for splitting wood logs which can utilize the hydraulic cylinders on a front end loader rather than requiring hydraulic cylinders of its own.

A further object of the present invention is the provision of a method and means for splitting wood logs whereby a front end loader may be quickly and easily modified to accommodate the log splitting device.

A further object of the present invention is the provision of a device for splitting logs which may be connected both to the frame of the front end loader and to the hydraulic cylinders of the front end loader in the place of the bucket normally carried by the front end loader.

A further object of the present invention is the provision of a method and means for splitting logs which is safe, economical to manufacture, and durable in use.

DETAILED DESCRIPTION OF THE DRAWINGS

Figure 1:
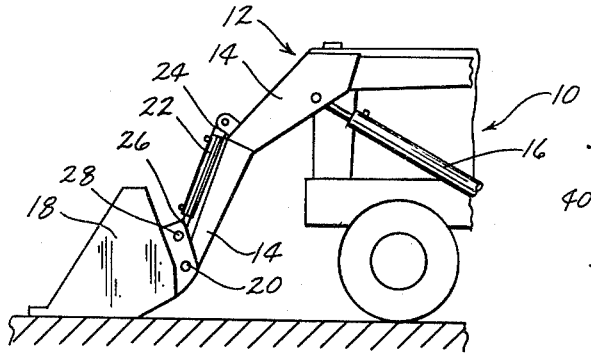
FIG. 1 is an elevational view of the front end of a tractor having a front end loader thereon prior to the mounting of the log splitting device of the present invention.

Referring to the drawings, the numeral 10 generally designates a tractor, and the numeral 12 generally designates a front end loader which is mounted to the tractor.

Front end loader 12 includes a pair of forwardly extending arms 14 each of which is pivotally mounted adjacent its rearward end (not shown) to the tractor. A pair of arm cylinders 16 are each connected at one end to arms 14 and at the other end (not shown) to the tractor 10. Actuation of cylinder 16 causes pivotal movement of arms 14 upwardly and downwardly about their horizontal pivotal connection to the tractor frame.

Referring to FIG. 1, a bucket 18 is pivotally mounted to the forward end of arms 14 for pivotal movement about a horizontal axis 20. A bucket cylinder 22 is pivotally connected at one of its ends 24 to arm 14 and at the other of its ends 26 to bucket 18 for pivotal movement about axis 28.

The method of the present invention initially requires the removal of bucket 18 from the forward ends of arms 14. This is accomplished by removing the pins which provide the pivotal axis 20 and 28. This process is easily accomplished with most front end loaders inasmuch as the pins at axis 20, 28 are normally constructed in such a fashion that they can be quickly and easily removed.

After removal of bucket 18, a wood splitting device generally designated by the numeral 30 is mounted on the forward ends of arms 14. Device 30 comprises a frame assembly 32 which has a pair of side frame members 34 interconnected at their forward ends by a cross frame plate 36. Rigidly secured to the upper surface of cross frame plate 36 is a wedge 38 having a sharpened edge 40 presented rearwardly toward the front end of the tractor. A guide channel 42 is welded or otherwise secured to cross frame plate 36 and extends rearwardly therefrom. The rearward end of guide channel 42 is provided with a yoke portion 44 adapted to retentively fit over a transverse member 46 extending between arms 14 of front end loader 12.

In cross-section, channel 42 has a U-shaped configuration comprising a web portion 48 and two upstanding legs 50.

Figure 3:
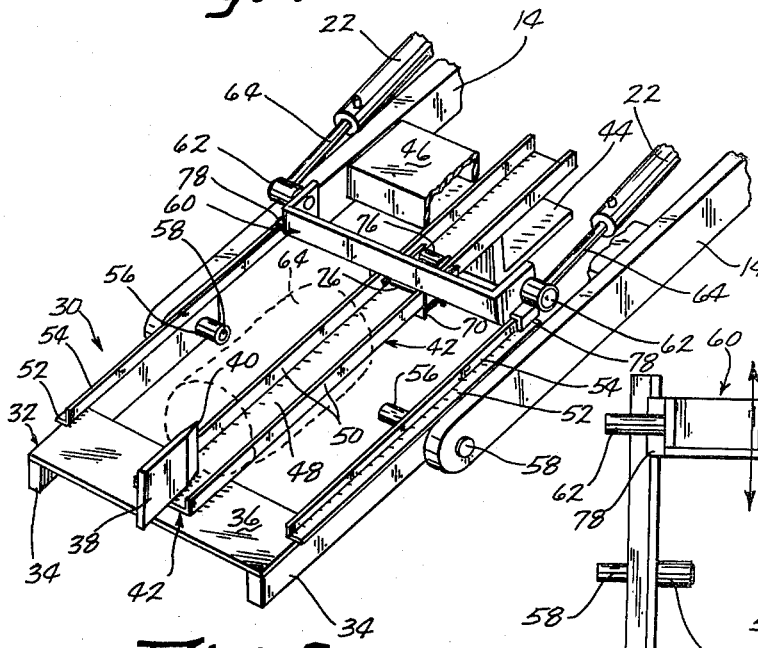
FIG. 3 is a detailed partial perspective view of the log splitting device mounted upon the front end loader.
Figure 4:
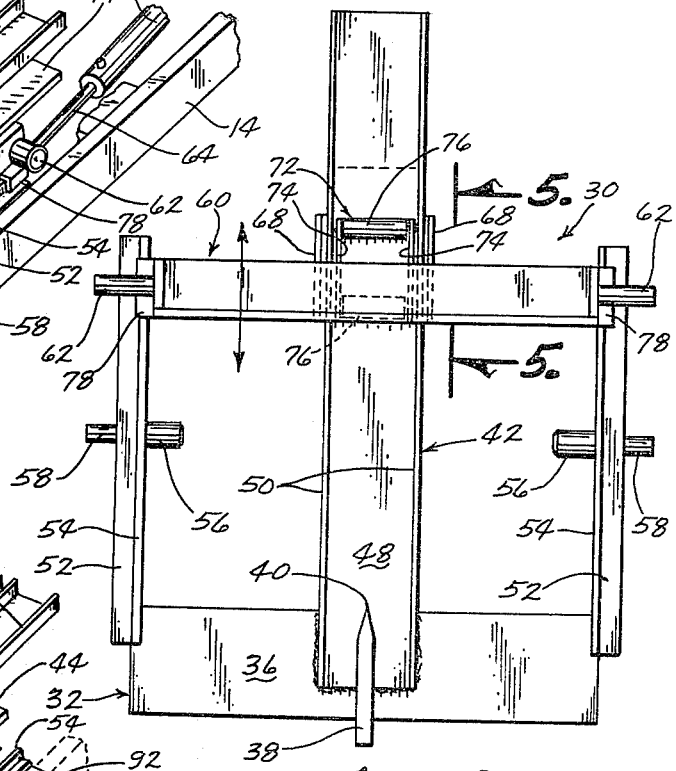
FIG. 4 is a top plan view of the log splitting device.

Rigidly secured to the upper edges of side frame members 34 are a pair of parallel angle members 52 each having a vertical angle portion 54. Side frame members 34 are also provided intermediate their opposite ends with a pair of pin receiving collars 56 each of which are adapted to receive a pin 58 for securing side frame members 34 to the forward ends of arms 14 on front end loader 12. As can be seen in FIG. 3, pins 58 extend through openings in the ends of arms 14 and protrude into collars 56 so as to secure arms 14 to side frame members 34. Pins 58 are sized to accommodate the openings in arms 14 which were previously used to pivotally mount bucket 18 for pivotal movement about axis 20.

As can be seen in FIG. 3, the interlocking engagement of yoke 44 about transverse member 46 cooperates with the locking engagement of arms 14 to side frame members 34 by means of pins 58 to hold frame assembly 32 rigid with respect to the front end loader 12.

Slidably mounted on guide channel 42 is a ram bar 60. Ram bar 60 includes a pair of pins 62 at its opposite ends for securing ram bar 62 to the piston rods 64 of bucket cylinders 22. Once this securement is made, the actuation of cylinders 22 causes ram bar 60 to move toward wedge 38, thereby causing a log 64 to be forced against sharp edge 40 of wedge 38 and to be impaled thereon and split.

Figure 5:
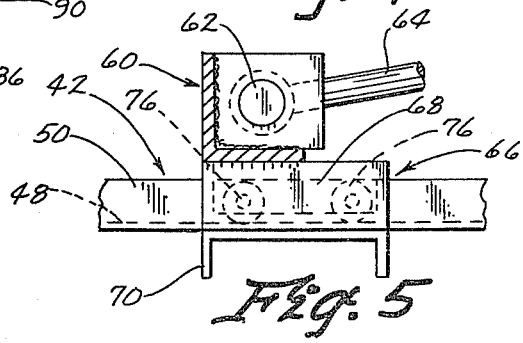
FIG. 5 is a sectional view taken along line 5—5 of FIG. 4.

The sliding attachment of ram bar 60 to frame assembly 32 is accomplished by means of a track follower 66 (FIG. 5). Track follower 66 is weldably secured to bar 60 and includes side plates 68 embracing the opposite sides of channel 42. A bottom channel 70 is welded to the bottom edges of side plates 68 and interconnect side plates 68 below guide channel 42. Thus, side plates 68 and bottom channel 70, together with bar 60 completely surround guide channel 42 so as to permit longitudinal sliding movement of ram bar 60 along the length of channel 42.

Also welded to ram bar 60 is a roller assembly 72 which includes a pair of parallel plates 74 which are welded at their upper edges to the bottom surface of ram bar 60 and which protrude downwardly within channel 32 in facing and spaced relationship to the inner surfaces of upstanding legs 50. A pair of rollers 76 are rotatably journaled between parallel plates 74 and bear against the upwardly presented surface of web 48. This rolling engagement of roller 76 against web 48 facilitates longitudinal sliding movement of ram bar 60 with respect to channel 32.

At the opposite ends of ram bar 60 are a pair of guide ears 78 which project outwardly and downwardly and which embrace the upper edges of vertical portions 54 of angle members 52. The interlocking engagement of ears 78 over angle member 72 permits ram bar 60 to slide longitudinally while at the same time guiding the opposite ends of ram bar 60 during such longitudinal sliding movement.

Figure 6:
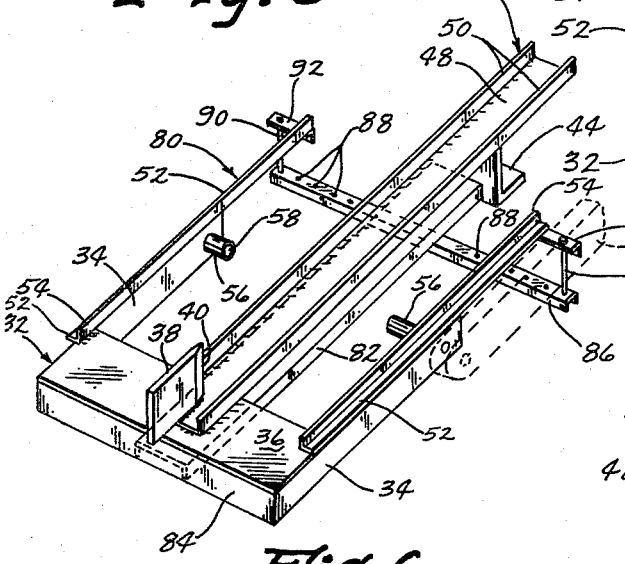
FIG. 6 is a perspective view of a modified form of the invention.

Referring to FIG. 6, a modified form of the present invention is shown and is designated by the numeral 80. Device 80 includes similar components as those shown in FIG. 3 for device 30, and corresponding numerals are used to identify those parts which are identical between the two devices, 30, 80. In addition, device 80 includes a longitudinal reinforcing member 82 which has one end welded or otherwise fixed to yoke 44 and which has the opposite end welded or otherwise fixed to a transverse end member 84. Reinforcing member 82 is spaced below and parallel to guide channel 42, and therefore forms a rectangular configuration with channel 42, yoke 44, and transverse end member 84. This reinforces the frame against buckling when subjected to the large forces created by ram bar 60 (not shown in FIG. 6).

Weldably secured to the bottom of longitudinal reinforcing member 82 and extending transversely thereto is a T-frame member 86. T-frame member 86 is provided with a plurality of holes 88 along the length thereof. At opposite ends of T-frame member 86 a pair of tie bolts 90 extend upwardly through holes 88. The upper ends of tie bolts 90 each extend through a hole in a stub member 92 which is weldably secured to the rearward ends of angle members 52, 54. As illustrated by shadow lines in FIG. 6, arms 14 of front end loader 12 extend between stub shafts 92 and T-frame member 86, and are embraced on their outer edges by tie bolts 90. Tightening of the nuts on tie bolts 90 causes stubs 92 and T-frame member 86 to be clamped to tightly embrace arms 14, and thereby enhance the securement of device 80 to front end loader 12.

Figure 2:
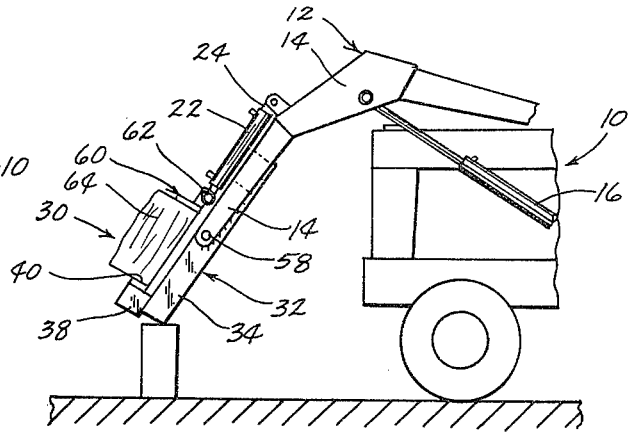
FIG. 2 is a view similar to FIG. 1 showing the bucket of the front end loader removed and the log splitting device mounted in the place of the bucket on the front end loader.

The present invention is easily used with conventional front end loaders. All that is necessary to make the present invention ready for operation is to remove bucket 18, to place frame assembly 32 on the front ends of arms 14 by means of pins 58 and by means of locking engagement of yoke 44 with transverse member 46, and by connecting the ends of bucket cylinders 22 to ram bar 60 as previously described. This may be accomplished in only a few minutes and does not require modification of the front end loaders presently being used. Once the device 30 is so assembled, a log 64 may be placed on top of channel 32 in the manner shown in FIGS. 2 and 3. Actuation of cylinders 20 causes ram 60 to force the log against the sharpened edge 40 of wedge 38 and the log is split. The device is simple and economical to manufacture, and thus accomplishes all of its stated objectives.

What is claimed is:

1. In combination:

a tractor having a forward end and two sides;

a loader assembly mounted on said tractor and comprising opposite loader arms pivotally secured to the sides of said tractor and extending forwardly of the forward end of said tractor;

first cylinder means connecting said tractor and said loader arms to raise and lower said loader arms, second cylinder means on said loader arms;

a frame assembly having a forward and a rearward end, said rearward end being secured to said loader arms forwardly of the forward end of said tractor, a cutting wedge rigidly secured to said forward end of said frame assembly, a ram bar slidably mounted on said frame assembly and adapted to slide towards and away from said cutting wedge, said ram bar being connected to said second cylinder means so that said second cylinder means can forcibly move said ram bar towards said cutting wedge whereby a log longitudinally positioned between said ram bar and said cutting wedge can be impaled upon and split by said cutting wedge said guide track member comprising a channel member having a U-shaped cross section formed by a web portion and two opposite legs extending upwardly from said web portion;

said track follower means comprising a yoke member attached to said ram bar and surrounding said channel member for longitudinal sliding movement thereon.

2. The combination of claim 1 wherein said frame assembly comprises an elongated guide track member, track follower means connecting said ram bar to said guide track member for sliding movement thereon towards and away from said cutting wedge.

3. The combination of claim 1 wherein said yoke includes roller members engaging said channel member for rolling movement thereon to facilitate longitudinal sliding movement of said yoke and ram bar along said channel member.

4. The combination of claim 3 wherein said frame assembly includes a pair of parallel side rails, said ram bar having a pair of guide ears located at opposite ends thereof and slidably engaging said rails for guided sliding movement thereon during sliding movement of said ram bar.

5. The combination of claim 1 wherein said frame assembly includes first mounting means thereon for detachably mounting said frame assembly to said loader arms; said ram bar having second mounting means thereon for detachably mounting said second cylinder means to said ram bar.

6. The combination according to claim 1 wherein said frame assembly includes adjacent said rearward end thereof an interlock frame member adapted to interlock with and retentively engage a portion of said loader assembly.

7. A log splitting device for mounting on a front end loader assembly of a tractor, said loader assembly comprising a pair of spaced apart arms each pivotally secured to one of the opposite sides of said tractor and extending forwardly thereform, each of said arms having a pin adjacent its forward end for detachably mounting a loader tool to said loader assembly, at least one cross member interconnecting said arms, first cylinder means interconnecting said arms to said tractor for raising and lowering said arms, second cylinder means on said arms adapted to be connected to a loader tool, said log splitting device comprising:

a frame assembly having a forward end, a rearward end and opposite side members, said side members each having pin receiving means intermediate their lengths for retentively receiving said pins to connect said frame assembly to said arms;

a cutting wedge rigidly secured to said forward end of said frame assembly, a ram bar slidably mounted on said frame assembly and adapted to slide towards and away from said cutting wedge, said ram bar being connectable to said second cylinder means so that said second cylinder means can forcibly move said ram bar towards said cutting wedge whereby a log longitudinally positioned between said ram bar and said cutting wedge can be impaled upon and split by said cutting wedge, said frame assembly having an integral interlock member thereon for interlocking with and retentively engaging said front end loader assembly so as to hold said frame assembly against pivotal movement about said pins when said frame assembly retentively receives said pins;

said interlock member comprising a yoke portion adapted to retentively fit over said one cross member interconnecting said arms.

* * * * *